US007395884B2

(12) United States Patent
Kembaiyan et al.

(10) Patent No.: US 7,395,884 B2
(45) **Date of Patent: *Jul. 8, 2008**

(54) HIGH-STRENGTH/HIGH TOUGHNESS ALLOY STEEL DRILL BIT BLANK

(75) Inventors: Kumar T. Kembaiyan, Spring, TX (US); Thomas W. Oldham, Spring, TX (US); John (Youhe) Zhang, Tomball, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/435,413

(22) Filed: May 16, 2006

(65) Prior Publication Data

US 2006/0201718 A1 Sep. 14, 2006

Related U.S. Application Data

(63) Continuation of application No. 10/356,381, filed on Jan. 31, 2003, now Pat. No. 7,044,243.

(51) Int. Cl.
*E21B 10/00* (2006.01)

(52) U.S. Cl. ..... 175/425; 76/108.2

(58) Field of Classification Search ..... 175/425, 175/435; 76/108.2, 108.4
See application file for complete search history.

(56) References Cited

U.S. PATENT DOCUMENTS 3,661,656 A * 5/1972 Jarleborg ..... 148/211
3,757,878 A * 9/1973 Wilder et al. ..... 175/434
3,842,921 A * 10/1974 Dill et al. ..... 175/374
3,885,838 A * 5/1975 Childers et al. ..... 384/95
3,946,817 A * 3/1976 Prince ..... 175/374
4,188,242 A * 2/1980 Scales ..... 148/217
4,303,137 A 12/1981 Fischer
4,333,364 A * 6/1982 Varel ..... 76/108.2
4,358,317 A * 11/1982 Abe ..... 420/111
4,597,456 A 7/1986 Ecer
4,643,051 A * 2/1987 Simons et al. ..... 148/220
4,726,432 A * 2/1988 Scott et al. ..... 175/375
4,867,015 A * 9/1989 Kane et al. ..... 76/108.2
4,969,378 A * 11/1990 Lu et al. ..... 148/212
5,033,559 A * 7/1991 Fischer ..... 175/431
6,148,936 A * 11/2000 Evans et al. ..... 175/425

(Continued)

*Primary Examiner*—Hoang Dang
(74) *Attorney, Agent, or Firm*—Connolly Bove Lodge & Hutz LLP

(57) ABSTRACT

Drill bit reinforcing members or blanks of this invention are formed from high-strength steels having a carbon content less than about 0.3 percent by weight, a yield strength of at least 55,000 psi, a tensile strength of at least 80,000 psi, a toughness of at least 40 CVN-L, Ft-lb, and a rate of expansion percentage change less than about 0.0025%/° F. during austenitic to ferritic phase transformation. In one embodiment, such steel comprises in the range of from about 0.1 to 0.3 percent by weight carbon, 0.5 to 1.5 percent by weight manganese, up to about 0.8 percent by weight chromium, 0.05 to 4 percent by weight nickel, and 0.02 to 0.8 percent by weight molybdenum. In another example, such steel comprises in the range of from about 0.1 to 0.3 percent by weight carbon, 0.9 to 1.5 percent by weight manganese, 0.1 to 0.5 percent by weight silicon, and one or more microalloying element selected from the group consisting of vanadium, niobium, titanium, zirconium, aluminum and mixtures thereof.

21 Claims, 5 Drawing Sheets

U.S. PATENT DOCUMENTS 6,287,360 B1 * 9/2001 Kembaiyan et al. ..... 75/240
6,354,740 B1 3/2002 Singh et al.
6,375,706 B2 * 4/2002 Kembaiyan et al. ..... 75/240
7,044,243 B2 * 5/2006 Kembaiyan et al. ..... 175/425

* cited by examiner

HIGH-STRENGTH/HIGH TOUGHNESS ALLOY STEEL DRILL BIT BLANK

RELATION TO COPENDIING PATENT APPLICATION

This patent application claims priority from U.S. patent application Ser. No. 10/356,381 that was filed on Jan. 31, 2003, and that has now issued as U.S. Pat. No. 7,044,243.

FIELD OF THE INVENTION

This invention relates generally to steel blanks used for forming earth-boring drill bits and, more particularly, to steel blanks used for forming polycrystalline diamond compact drill bits having improved properties of strength and toughness when compared to conventional drill bit steel blanks.

BACKGROUND OF THE INVENTION

Earth-boring drill bits comprising one or more polycrystalline diamond compact ("PDC") cutters are known in the art, and are referred to in the industry as PDC bits. Typically, PDC bits include an integral bit body that can be made of steel or fabricated of a hard matrix material such as tungsten carbide (WC). Tungsten carbide or other hard metal matrix body bits have the advantage of higher wear and erosion resistance when compared to steel body bits. Such matrix bits are generally formed by packing a graphite mold with tungsten carbide powder, and then infiltrating the powder with a molten copper-based alloy binder.

A plurality of diamond cutter devices, e.g., PDC cutters, are mounted along the exterior face of the bit body. Each diamond cutter has a stud portion which typically is brazed in a recess or pocket in the exterior face of the bit body. The PDC cutters are positioned along the leading edges of the bit body so that, as the bit body is rotated in its intended direction of use, the PDC cutters engage and drill the earth formation.

Such PDC bits are formed having a reinforcing/connecting member beneath the bit body that is bonded thereto. The reinforcing member is referred in the industry as a blank, and is provided during the process of making the bit for the purpose of connecting the bit body to a hardened steel upper section of the bit that connects the bit to the drill string. The blank is also used to provide structural strength and toughness to the bit body when the body is formed from a relatively brittle matrix material such as tungsten carbide, thereby helping to minimize undesirable fracture of the body during service.

Conventionally, such drill bit blanks have been formed from plain-carbon steels such as AISI 1018 or AISI 1020 steels because these steels remain relatively tough after infiltration of the bit body material therein (during sintering of the bit). Also, the use of such plain-carbon steels is desirable because they are easily weldable without the need for special welding provisions such as preheating and postheating, for purposes of connecting the bit upper steel section thereto. Additionally, tungsten carbide matrix bits made from plain-carbon steels are less vulnerable to transformation induced cracking that occurs when the drill bit is cooled from the infiltration temperature to ambient temperature. The reason for this is that the plain-carbon steel has a coefficient of thermal expansion that does not produce a drastic volume change during the phase transformation range as compared to the other alloyed steels.

A problem, however, that is known when using such plain-carbon steels for forming the drill bit blanks is that such materials lack a degree of strength necessary for application with today's high performance drill bits. Such high performance bits generate a high amount of torque during use due to their aggressive cutting structures, which torque requires a higher level of drill bit blank strength to provide a meaningful drill bit service life. The low degree of strength exhibited by such conventional steel blanks is caused both by the absence of alloying elements, and by excessive softening that occurs during thermal processes that must be performed during the bit manufacturing process.

It is, therefore, desirable that a drill bit blank be developed having improved strength when compared to conventional plain-carbon steel drill bit blanks. It is desired that such drill bit blanks also provide a degree of weldability that is the same as conventional plain steel drill bit blanks. It is also desired that such drill bit blank undergoes minimal volume change during thermal changes so as to induce minimal stresses in the tungsten carbide matrix material during manufacturing. It is further desired that such drill bit blanks be capable of being formed by conventional machining methods using materials that are readily available.

SUMMARY OF THE INVENTION

Drill bit reinforcing members or blanks constructed in accordance with this invention are formed from high-strength steels having a carbon content less than about 0.3 percent by weight, and having a yield strength of at least 55,000 psi, a tensile strength of at least 80,000 psi, and a toughness of at least 40 CVN-L, Ft-lb. It is desired that the high-strength steel have a rate of expansion percentage change less than about 0.0025%/.degree. F. during austenitic to ferritic phase transformation.

In one example embodiment, the high-strength steel is a low carbon, low alloy steel comprising in the range of from about 0.1 to 0.3 percent by weight carbon, 0.5 to 1.5 percent by weight manganese, up to about 0.8 percent by weight chromium, 0.05 to 4 percent by weight nickel, and 0.01 to 0.8 percent by weight molybdenum. In another example embodiment, the high-strength steel is a low carbon, microalloyed steel comprising in the range of from about 0.1 to 0.3 percent by weight carbon, 0.9 to 1.5 percent by weight manganese, 0.15 to 0.3 percent by weight silicon, up to about 0.8 percent by weight chromium, nickel up to about 2 percent by weight, and one or more microalloying element selected from the group consisting of vanadium, niobium, titanium, zirconium, aluminum and mixtures thereof.

Drill bit reinforcing members of this invention made from such steels provide a marked improvement in strength over reinforcing members formed from conventional plain-carbon steels, making them particularly well suited for use in today's high performance drill bit applications

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE INVENTION

The invention is based, in part, on the realization that the strength and toughness of a drill bit blank used in forming earth-boring drill bits play an important role in determining the meaningful service life of such drill bits. Drill bit blanks, constructed according to the principles of this invention, are formed from low carbon alloy steels and provide improved strength when compared to conventional drill bit blanks formed from plain-carbon steels. Further, the steels used to form drill bit blanks of this invention are specifically engineered to undergo a relatively low degree of volume change during transformation so that they induce minimal stress into the drill bit matrix materials during manufacturing. Drill bit blanks provided in accordance with this invention provide such improvements while maintaining good weldability. This combination of properties provides improved bit service life when compared to drill bits formed using conventional drill bit blanks.

Improved drill bit blanks of this invention can be used with a variety of different drill bits that are known to make use of such blanks in making and completing a drill bit body. Typically, drill bit blanks of this invention are used in making drill bits having a matrix bit body that is formed from a wear resistant material such as tungsten carbide and the like, wherein the drill bit blanks are used to provide strength to the drill bit, and provide an attachment point between the bit body and a hardened steel upper section of the bit that connects the bit to a drill string. An example embodiment of such matrix body bit is a PDC drag bit.

Although drill bit blanks of this invention are useful for making PDC drill bits, it is to be understood within the scope of this invention that such drill bit blanks can be used to form drill bits other than those specifically described and illustrated herein. For example, drill bit blanks of this invention can be used to form any type of earth-boring bit that holds one or more cutter or cutting element in place. Such earth-boring bits include PDC drag bits, diamond coring bits, impregnated diamond bits, etc. These earth-boring bits may be used to drill a well bore by placing a cutting surface of the bit against an earthen formation.

Figure 1:
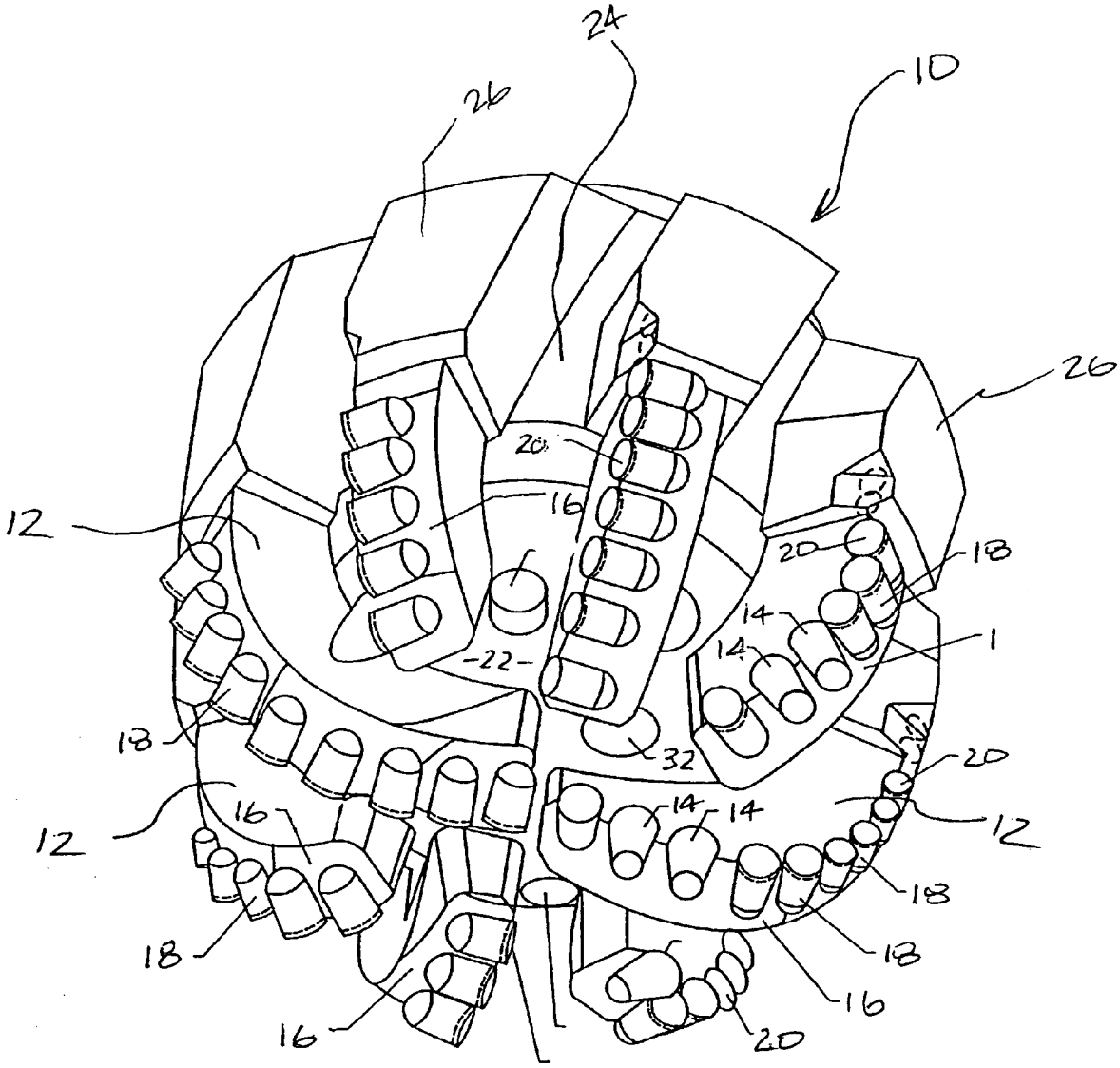
FIG. 1 is a perspective view of an earth-boring PDC drill bit body with some cutters in place according to the principles of the invention.

FIG. 1 illustrates a PDC drag bit body 10 comprising an improved drill bit blank or reinforcing member, constructed in accordance with the principles of this invention. The PDC drag bit body is formed having a number of blades 12 projecting outwardly from a body lower end. A plurality of recesses or pockets 14 are formed within a face 16 in the blades to receive a plurality of polycrystalline diamond compact cutters 18. The PDC cutters 18, typically cylindrical in shape, are made from a hard material such as cemented tungsten carbide and have a polycrystalline diamond layer covering a cutting face 20. The PDC cutters are brazed into the pockets after the bit body has been made. Methods of making polycrystalline diamond compacts are known in the art and are disclosed in U.S. Pat. Nos. 3,745,623 and 5,676,496, for example, which are incorporated herein by reference.

It should be understood that, in addition to PDC cutters, other types of cutters also may be used in embodiments of the invention. For example, cutters made from cermet materials such as carbide or cemented carbide, particularly cemented tungsten carbide, are suitable for some drilling applications. For other applications, polycrystalline cubic boron nitride cutters may be employed.

The portion of the bit body formed from the matrix material includes the blades 12 and the outside surface 22 of the body from which the blades project. The drag bit body 10 includes an upper section 24 at an end of the body opposite from the body lower end. In an example embodiment, the drag bit body upper section 24 is formed from a machinable and weldable material, such as a hardened steel. The body upper section 24 provides a structural means for connecting the matrix bit body to the drill bit blank.

Figure 2:
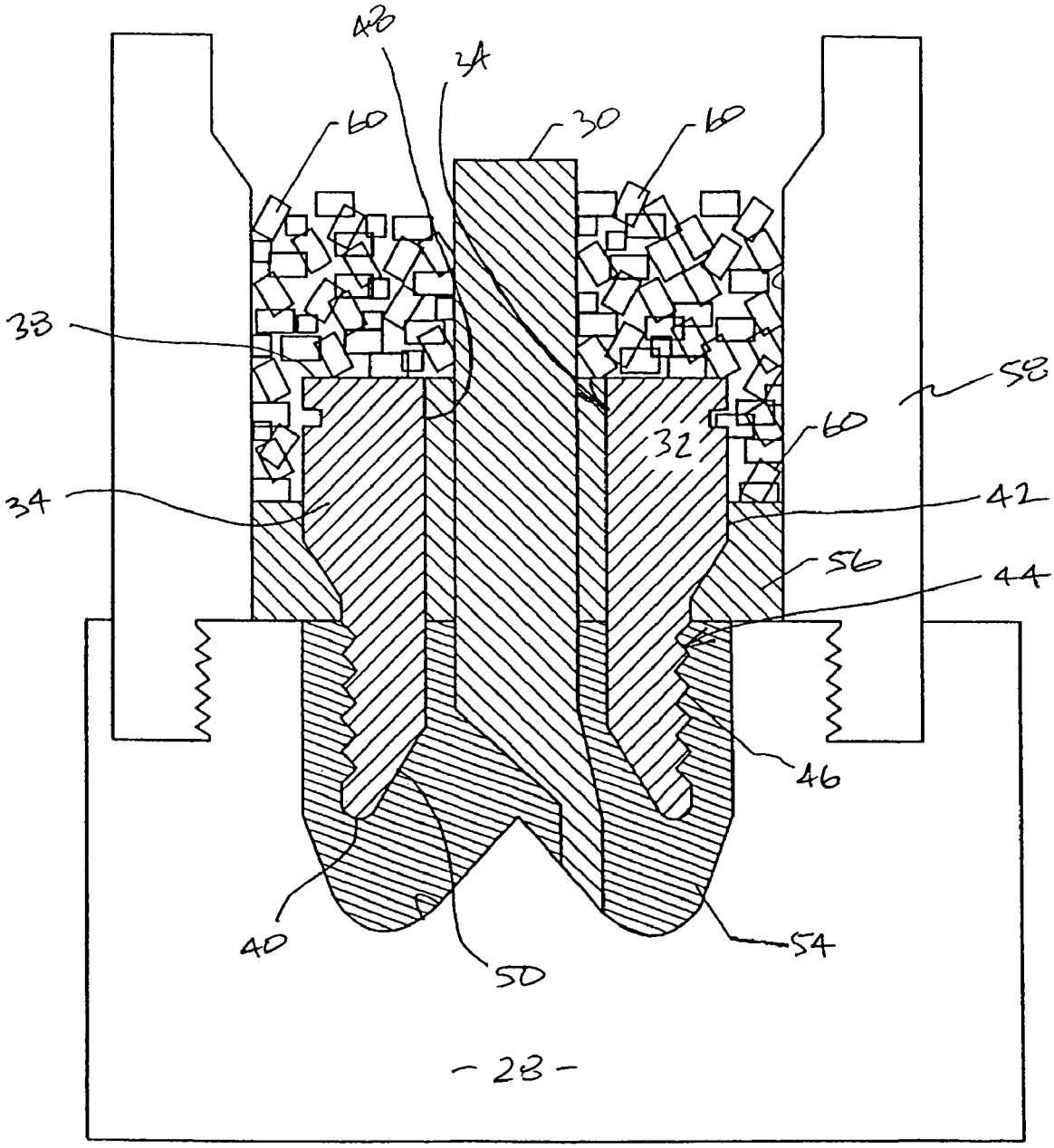
FIG. 2 is a cross-sectional schematic illustration of a mold and materials used to manufacture an earth-boring drill bit comprising a drill bit blank of this invention.

FIG. 2 illustrates an assembly for making a drag bit comprising a drill bit blank of this invention. In an example embodiment, the drag bit comprising the drill bit blank of this invention, is made by an infiltration process. Specifically, the drag bit is made by first fabricating a mold 28, preferably made from a graphite material, having the desired bit body shape and cutter configuration. Sand cores 30 are strategically positioned within the mold to form one or more fluid passages through the bit body (see 32 in FIG. 1). An improved drill bit blank or reinforcing member 32, constructed in accordance with this invention, is placed into the mold 28.

Figure 3:
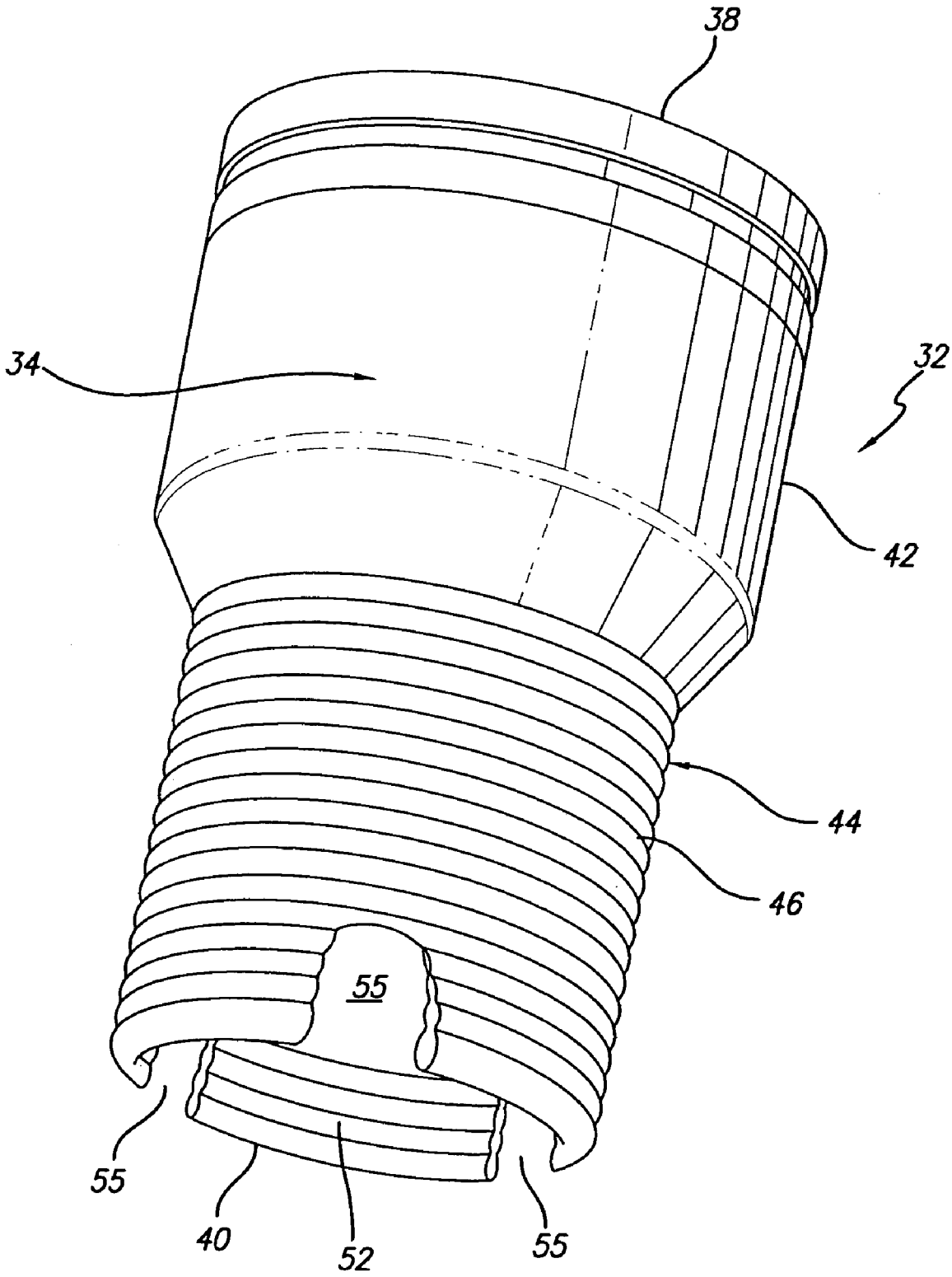
FIG. 3 is a perspective view of the drill bit blank of FIG. 2.

Referring to FIGS. 2 and 3, the blank 32 comprises a generally cylindrical body 34 having a central opening 36 extending therethrough between first and second opposed axial ends 38 and 40. In an example embodiment, the body 34 has a stepped configuration defined by a first outside diameter section 42 extending axially a distance from the first axial end 38, and a second outside diameter section 44 extending axially from the first diameter section to the second axial end 40, wherein the second diameter section is smaller than the first diameter section. The second outside diameter section 44 has an outside surface comprising a number of grooves 46 disposed circumferentially therearound. As better described below, the grooves are provided to enhance the degree of mechanical interaction between the blank and an adjacent bit structure.

In such example embodiment, the blank central opening 36 is configured having a first inside diameter section 48 of constant dimension extending axially a distance through the blank starting from first axial end 38. The opening 36 includes a second inside diameter section 50 of increasing dimension extending axially from the first inside diameter section to the second axial end 40. In a preferred embodiment, the opening second inside diameter section 50 additionally comprises a surface characterized by a number of grooves 52 (as best shown in FIG. 3) disposed circumferentially therearound. The blank second axial end 40 can also include one or more axially oriented slots 55 or notches disposed therein for purposes of preventing possible radial dislodgment movement of the blank within the bit body during drilling operation.

While a specifically configured drill bit blank has been disclosed and illustrated, it is to be understood that drill bit blanks constructed in accordance with the principles of this invention can have one of a number of different configurations, depending on the particular type of bit being constructed, and the particular application for the bit. Therefore, drill bit blanks of this invention can be configured differently than disclosed and illustrated without departing from the spirit of this invention.

A desired refractory compound 54, e.g., comprising tungsten carbide powder, is introduced into the mold 28. The grooves 46 and 52 in the steel blank are provided to enhance the bonding and/or mechanical interplay between the blank and the resulting matrix body after infiltration. The refractory compound 54 is compacted by conventional method, and a machinable and weldable material 56, preferably tungsten metal powder, is introduced into the mold on top of the refractory compound. The machinable and weldable material 56 provides a means for connecting the bit body, e.g., formed from the tungsten carbide refractory compound, to the steel blank. A temporary grip on the steel blank (not shown) can be released as the steel blank is now supported by the refractory compound 54 and machinable material 56. A funnel 58, e.g., formed from graphite, is attached to the top of the mold, and an infiltration binder alloy in the form of small slugs 60 is introduced into the funnel around the steel blank 32 and above the machinable material 56 level.

The mold, funnel, and materials contained therein then are placed in a furnace and heated/sintered above the melting point of the infiltration binder, e.g., to temperature of about 2,100.degree. F. The infiltration binder then flows into and wets the machinable material and refractory powder by capillary action, thus cementing the material, powder and the steel blank together. After cooling, the bit body is removed from the mold and is ready for fabrication into a drill bit.

The drill bit blanks of this invention are formed from a material having combined properties of strength and toughness that is suitable for providing a desired degree of structural reinforcement to the bit body during demanding drilling operations. A key feature of bit blanks of this invention is that they possess such improved properties of strength combined with adequate toughness at a time after the blank has been exposed to the infiltration process. Drill bit blanks formed from conventional plain-carbon steels typically demonstrate a good degree of toughness, but lack a desired amount of strength for aggressive bit designs.

Additionally, drill bit blanks of this invention are formed from materials that produce a low degree of thermally-induced volumetric change, e.g., thermal expansion, during manufacturing when the drill bit is cooled down from the infiltration process and through the phase-change region of the steel alloy. Drill bits are typically infiltrated at high temperature, e.g., in the above-noted example embodiment at a temperature of about 2,150.degree. F. When the bit is cooled from this temperature, steel is known to change from a face-centered cubic crystal structure (austenite) to a lamellar mixture of ferrite and cementite (pearlite). Ferrite, which is a predominant constituent in the pearlite, has a body-centered cubic crystal structure. Because the face-centered cubic structure of steel is more densely compacted than the body-centered cubic structure, as the bit blank formed from steel within the bit cools from the infiltration process (and transitions from a face-centered cubic structure to a predominately body-centered cubic based pearlitic structure), it undergoes a phase change expansion. The phase change expansion of a drill bit blank formed from steel, if sufficient in magnitude, can cause thermal stresses in the matrix body surrounding the blank, which can ultimately produce cracks that can render the so-formed drill bit unsuited for drilling service.

Materials well-suited for use in forming drill bit blanks of this invention, and that meet the above-noted criteria of high strength, adequate toughness and low change in thermal expansion, must derive their properties from a suitable set of alloying elements. The alloying elements chosen to strengthen the blanks must do so by solution strengthening of ferrite, or by the formation of extremely fine carbides and grain refinement. Since the steel is cooled slowly from the infiltration temperature, the steel must not contain too much carbon so as to prevent the formation of brittle carbides. Further, the types of alloying elements, as well as the concentrations of these elements, must be selected to preclude the formation of detrimental carbides and carbide networks along the grain boundaries. Such carbides, if allowed to form during the cooling process, can operate to lower the resulting toughness of the steel dramatically. Finally, in an effort to minimize the generation of thermally induced stress during cooling from the infiltration process, the alloying elements that are selected must not significantly increase the steel's phase change expansion characteristics.

Steels useful for forming drill bit blanks of this invention are selected from the group of steels referred to as low carbon steels and, more specifically, low carbon, low alloy steels and low carbon, microalloyed steels. Steels in this group typically have less than about 0.3 percent carbon in order to prevent the formation of brittle carbides. Low carbon, low alloy steels useful for forming drill bit blanks according to principles of this invention comprise low carbon versions of alloy steels that include in whole or in part nickel and molybdenum alloying agents to derive the above-described desired properties. Examples of such low carbon, low alloy steels include those identified by the AISI or SAE number as 47xx steels (steels characterized as comprising molybdenum, nickel, and chromium alloying elements) and 48xx steels (steels characterized as comprising nickel and molybdenum alloying elements). Particularly preferred low carbon versions of the 47xx series steels and 48xx series steels include SAE 4715, SAE 4720, SAE 4815 and SAE 4820 steels.

Low carbon, microalloyed steels useful for forming drill bit blanks according to this invention comprise low carbon steels having small additions of one of more micro-alloying elements selected from the group consisting of vanadium, niobium, titanium, zirconium and aluminum. Particularly preferred low carbon, microalloyed steels include those containing less than about 0.2 percent by weight (pbwt) total of such micro-alloying elements. The use of one or more of such micro-alloying elements selected from this group is desired because these micro-alloying elements are proven to be strong grain refining agents. As such, they operate to lock the grain boundaries (in the form of segregants and/or very fine precipitates) from excessive migration when under thermal or mechanical stress, thereby improving the yield strength of the steel. In addition to these micro-alloying ingredients, it is desired that such low carbon, microalloyed steel include silicon. Silicone is useful as a deoxidizer that operates to stabilize and strength the ferrite grain. Although particular types of low carbon steels have been specifically described, it is to be understood that any other low carbon alloy steel having a chemical composition similar to that disclosed above can also be suitably used for this application.

In an example embodiment, drill bit blanks of this invention are formed from a low carbon, low alloy steel comprising carbon in the range of from about 0.1 to 0.3 (pbwt), manganese in the range of from about 0.5 to 1.5 pbwt, chromium up to about 0.8 pbwt, nickel in the range of from about 0.05 to 4 pbwt, and molybdenum in the range of from about 0.01 to 0.8 pbwt as major alloying elements, and the remaining amount iron. Steels manufactured having the above-disclosed composition of elements are desired because they produce a desired combination of high strength, adequate toughness, and low changes in thermal expansion when compared to plain-carbon steel conventionally used to make drill bit blanks.

A low carbon, low alloy steel comprising an amount of carbon greater than about 0.3 pbwt is not desired because it will encourage the formation of carbide precipitates and networks of these carbides, and thus reduce toughness. A steel comprising an amount of manganese outside of the above-identified range is not desired because too little manganese will produce a steel having a reduced amount of strength, and too much manganese will reduce the solubility of other alloying elements. A steel comprising an amount of chromium greater than about 0.8 pbwt is not desired because it will tend to form brittle carbides. A low carbon, low alloy steel comprising an amount of nickel outside of the above-identified range is not desired because of its adverse effect on the coefficient of thermal expansion, which can cause matrix cracking. A steel comprising an amount of molybdenum outside of the above-identified range is not desired because excessive molybdenum can increase the formation of detrimental carbides.

In an example embodiment, the drill bit blank of this invention is formed from a low carbon, microalloyed steel comprising carbon in the range of from about 0.1 to 0.3 pbwt, manganese in the range of from about 0.9 to 1.5 pbwt, chromium up to about 0.8 pbwt, nickel up to about 2 pbwt, molybdenum up to about 0.2 pbwt, silicon in the range of from about 0.15 to 0.3 pbwt as major alloying elements, and up to about 0.2 total pbwt of one of more of the microalloying elements selected from the group consisting of vanadium, niobium, titanium, zirconium and aluminum, and the remaining amount iron.

A low carbon, microalloyed steel comprising an amount of carbon greater than about 0.3 pbwt is not desired because it will encourage the formation of carbide precipitates and networks of these carbides, and thus reduce toughness. A steel comprising an amount of manganese outside of the above-identified range is not desired because too little manganese will produce a steel having a reduced amount of strength, and too much manganese will reduce the solubility of alloying elements. A steel comprising chromium in an amount greater than about 0.8 pbwt is not desired because it will tend to form brittle carbides. A low carbon, microalloyed steel comprising nickel in an amount greater than about 2 pbwt is not desired because of its adverse effect on the coefficient of thermal expansion, which can cause matrix cracking. A steel comprising molybdenum in an amount above about 0.2 pbwt is not desired because it can increase the formation of detrimental carbides. A low carbon, microalloyed steel comprising silicon in an amount greater than about 0.3 pbwt is not desired as it could cause surface defects and could limit the ductility of the steel for a desired application. A steel comprising one or more microalloying elements in an amount greater than bout 0.2 total pbwt is not desired because the higher amounts of microalloying elements will form coarse precipitates at the grain boundaries and lower the toughness.

Although the so-formed high-strength steel blanks of this invention can be used in all types of matrix PDC bits, they are particularly suited for drill bits designed for use in rotary-steerable or dual-torque applications. Bits designed for these types of applications require blank steels with higher strength than other bits. These bits have also been designed to be as short in length as possible to facilitate directional drilling. In order to make the bit short, the breaker slot has been machined partially into the bit blank, rather than completely within the heat-treated upper section. The presence of the breaker slot in the steel blank weakens the blank, thereby requiring that it be made from a stronger steel.

The above-identified invention will be better understood with reference to the following examples.

EXAMPLE NO. 1

Low Carbon, Low Alloy Steel Composition

A PDC drill bit was constructed, according to the principles of this invention, by the above-described infiltration method (illustrated in FIG. 2) comprising lowering a drill bit blank into a graphite mold. The drill bit blank was configured in the manner described above and illustrated in FIGS. 2 and 3, and was formed from a low carbon, low alloy steel comprising carbon in the range of 0.13 to 0.18 pbwt, manganese in the range of 0.7 to 0.9 pbwt, chromium in the range of 0.45 to 0.65 pbwt, nickel in the range of 0.7 to 1 pbwt, molybdenum in the range of 0.45 to 0.65 pbwt as major alloying elements, and a remaining amount iron. Low carbon, low alloy steels comprising this material composition include SAE 4715 steel (also referred to as PS-30) and PS-55 steel. A preferred low carbon, low alloy steels is SAE 4715 steel, which comprises nominally 0.15 pbwt carbon, 0.8 pbwt manganese, 0.55 pbwt chromium, 0.85 pbwt nickel, and 0.55 pbwt molybdenum.

A refractory metal matrix powder comprising mainly of tungsten carbide was introduced into the mold and compacted by conventional compaction technique. A machinable powder comprising mainly of tungsten powder was introduced into the mold, and a copper-based infiltration binder alloy was placed above the machinable material powder. The mold and its contents were placed into a furnace operated at a temperature of approximately 2,150.degree. F. for 2½ hours. After completion of the infiltration cycle, the bit was removed from the furnace and cooled slowly to solidify the metal matrix. The solidified metal matrix was dye penetrant inspected after infiltration and after cutter brazing. No cracks occurred in the bit body.

EXAMPLE NO. 2

Low Carbon, Microalloyed Steel Composition

A PDC drill bit was constructed, according to the principles of this invention, by the above-described infiltration method (illustrated in FIG. 2) comprising lowering a drill bit blank into a graphite mold. The drill bit blank was configured in the manner described above and illustrated in FIGS. 2 and 3, and was formed from a low carbon, microalloyed steel comprising carbon in the range of from about 0.1 to 0.3 pbwt, manganese in the range of from about 0.9 to 1.5 pbwt, chromium in the range of from about 0.01 to 0.25 pbwt, nickel in the range of from about 0.01 to 0.2 pbwt, molybdenum in the range of from about 0.001 to 0.1 pbwt as major alloying elements, silicon in the range of from about 0.15 to 0.3, one of the microalloying elements in the following ranges: vanadium in the range of from about 0.05 to 0.15 pbwt, niobium in the range of from about 0.01 to 0.1 pbwt, and titanium in the range of from about 0.01 to 1 pbwt, and a remaining amount iron. Low carbon, microalloyed steels comprising this material composition include WMA65 and SAE 1522V steels. A preferred low carbon, microalloyed steel is SAE 1522V, which comprises nominally 0.22 pbwt carbon, 1.26 pbwt manganese, 0.06 pbwt chromium, 0.07 pbwt nickel, 0.07 pbwt molybdenum, 0.28 pbwt silicon, 0.07 vanadium, 0.001 niobium, and a remaining amount iron.

A refractory metal matrix powder comprising mainly of tungsten carbide was introduced into the mold and compacted by conventional compaction technique. A machinable powder comprising mainly of tungsten powder was introduced into the mold, and a copper-based infiltration binder alloy was placed above the machinable material powder. The mold and its contents were placed into a furnace operated at a temperature of approximately 2,150.degree. F. for 2½ hours. After completion of the infiltration cycle, the bit was removed from the furnace and cooled slowly to solidify the metal matrix.

The solidified metal matrix was dye penetrant inspected after infiltration and after cutter brazing. No cracks occurred in the bit body.

Drill bit blanks constructed in accordance with the practice of this invention provide improved strength (both yield strength and tensile strength) when compared to conventional steel drill bit blanks formed from plain-carbon steel. The following table presents test data demonstrating the comparative strength of steels tested for use in forming bit blanks.

| Test No. | Steel | Type of Steel | Yield Strength (psi) | Tensile Strength (psi) | Toughness (CVN-L, ft-lb) |
|---|---|---|---|---|---|
| 1 | SAE 1018 | Plain Low-Carbon | 39,017 | 72,250 | 91 |
| 2 | SAE 1040 | Plain Medium-Carbon | 59,200 | 109,900 | 8 |
| 3 | SAE 8620 | Low-carbon, Chrome-Moly | 49,800 | 87,900 | 24 |
| 4 | SAE 8630 | Medium-carbon, Chrome-Moly | 100,600 | 144,400 | 6 |
| 5 | SAE 4815 | Low-Carbon, Nickel-Moly | 70,800 | 93,400 | 63 |
| 6 | SAE 4715 | Low-Carbon, Nickel-Chrome-Moly | 69,000 | 98,000 | 43 |
| 7 | PS-55 | Low-Carbon, Nickel-Chrome-Moly | 88,000 | 118,000 | 43 |
| 6 | WMA65 | Low-Carbon, Microalloyed | 64,800 | 95,900 | 29 |
| 7 | SAE 1522V | Low-Carbon, Microalloyed | 57,600 | 88,500 | 107 |

This table provides a summary of mechanical properties obtained on several candidate blank steels. All these candidate steels were infiltration simulated at 2,150.degree. F., and then subjected to mechanical testing. The SAE 1018 steel is a plain-carbon steel that is the standard blank steel widely used in the industry. Even though it possesses good toughness, the yield and tensile strengths are very low when compared to all other candidates. The medium-carbon, plain-carbon steel SAE 1040 offers better strength than that of the SAE 1018 steel, but exhibits very poor toughness. Other low carbon alloys steels such as SAE 8620 steel offer good strength but poor toughness after infiltration. The low carbon, microalloyed steel WMA65 offers good strength but poor toughness similar to SAE 1040. The test data shows that a good combination of strength and toughness is offered by the low carbon, low alloy steels PS55, SAE 4815 and SAE 4715, while the low carbon, microalloyed steel SAE 1522V offers good toughness, although its strength was less than that of the 4815, 4715 and PS55 steels.

It is generally desired that steels useful for forming drill bit blanks according to the principles of this invention have the following combined properties: a yield strength of at least 55,000 psi; a tensile strength of at least 80,000 psi; and a toughness of at least 40 CVN-L, Ft-lb. As illustrated in the table, low carbon, low alloy and low carbon, microalloyed steels of this invention provide these desired combined properties that make them particularly well suited for application as a drill bit blank.

Figure 4:
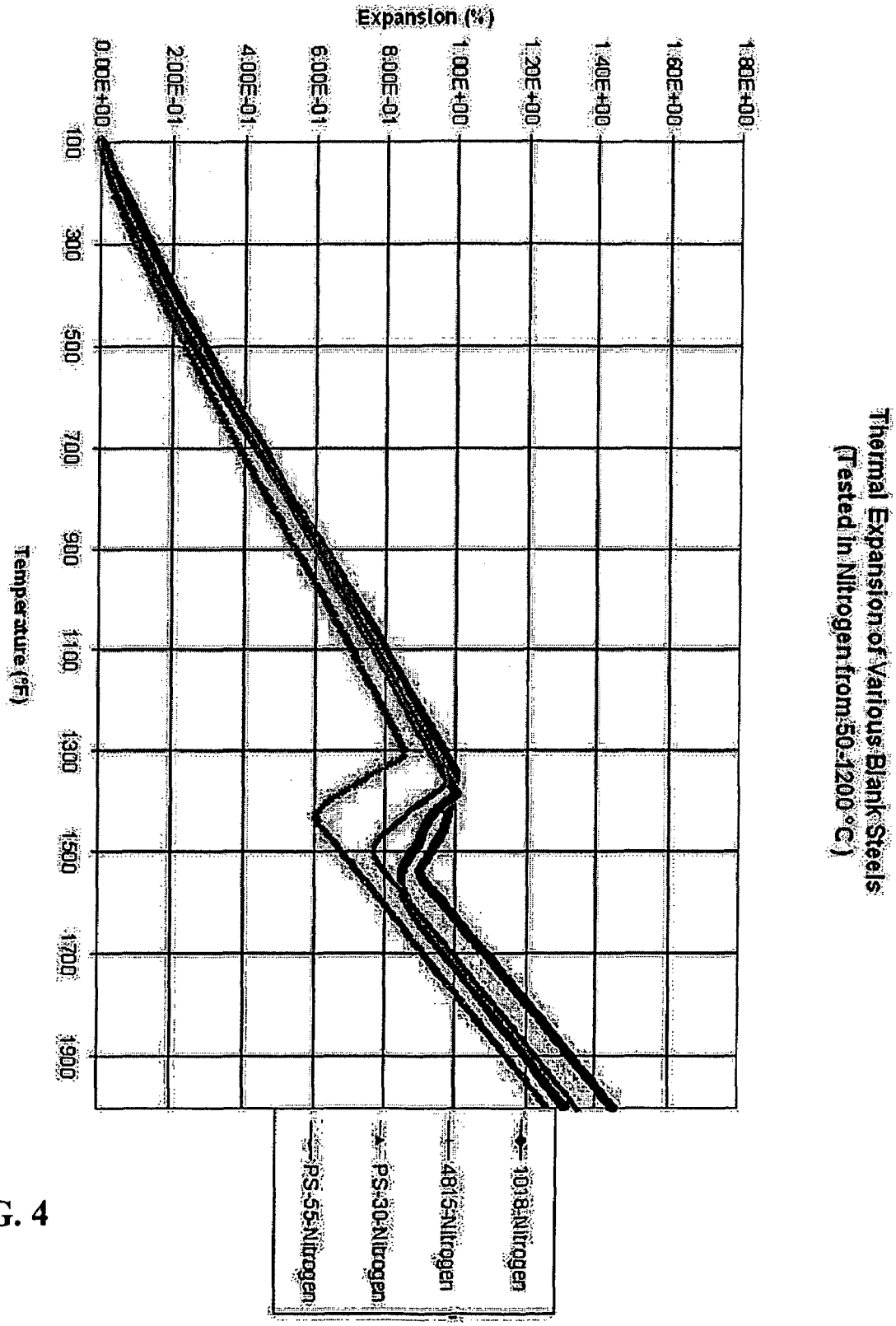
FIG. 4 is a graph illustrating the thermal expansion characteristics of various blank steels.

Another important aspect of the invention is that drill bit blanks made from the aforementioned low carbon, low alloy and low carbon, microalloyed steels provide a relatively low degree of thermal expansion change during transformation. FIG. 4 illustrates the thermal expansion characteristics of such steels.

The coefficient of thermal expansion of the low carbon, low alloy steels SAE 4815, SAE 4715 and PS-55 are compared with that of the standard blank plain-carbon steel SAE 1018. All of these steels offer superior strength when compared with the standard SAB 1018 blank steel currently used in the industry (as discussed above and demonstrated in the test data presented in the table). The test samples of these representative steels are cooled from 2000.degree. F. in a nitrogen atmosphere (so as preclude the samples from oxidation) in a furnace while their dimensional changes during cooling process are dynamically measured by use of dilatometric equipment. The expansion of the steels during the phase transformation is highlighted in FIG. 5.

Figure 5:
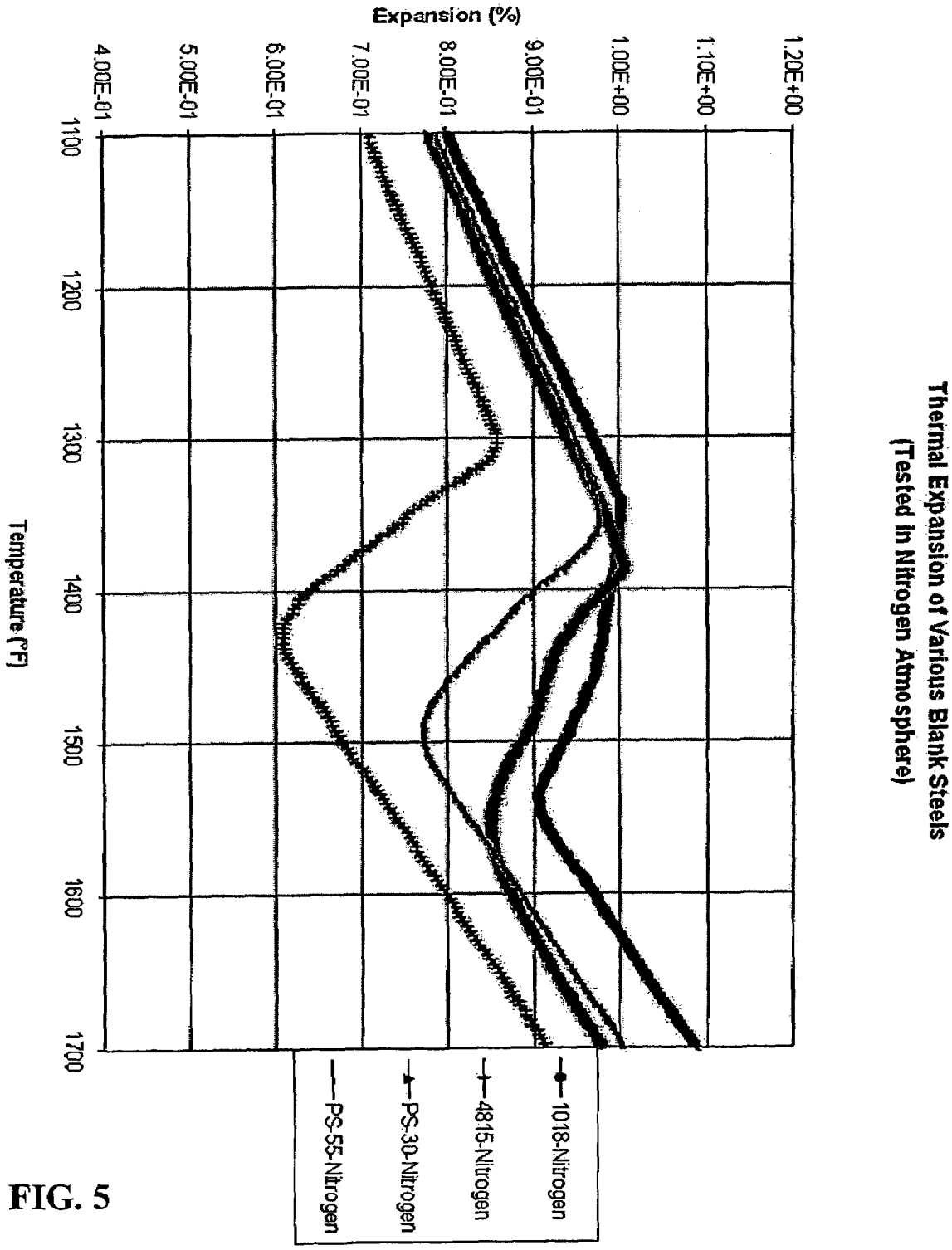
FIG. 5 is a graph that focuses on the phase transition portion of the thermal expansion characteristics of the steels shown in FIG. 4.

As illustrated in FIG. 5, the SAE 1018 steel undergoes the least drastic expansion change during the identified transformation temperature range. The rate of expansion percentage change as a function of temperature for the SAE 1018 steel is approximately 0.0005%/.degree. F.

Generally speaking, the lower the rate of expansion percentage change, the less drastically the steel expands over a given temperature range (e.g., between about 1,300.degree. F. to 1550.degree. F. during the austenitic to ferritic phase transformation region). FIG. 5 illustrates that the low carbon, low alloy steel SAE 4715 (designated as PS30 in the graph) has a thermal expansion characteristic that is less drastic than that of the both SAE 4815 and PS-55 steels. The rate of expansion percentage change as a function of temperature for the PS-30 or SAE 4715 steel is approximately 0.00091%/.degree. F., while that for the PS-55 steel is approximately 0.00145%/.degree. F., and that for the SAE 4815 steel is approximately 0.00191%/.degree. F. Moreover, the SAE 4715 steel is more cost effective to produce when compared with PS-55 and SAE 4815 steels. a function of temperature for the PS-30 or SAE 4715 steel is approximately 0.00091%/.degree. F., while that for the PS-55 steel is approximately 0.00145%/.degree. F., and that for the SAE 4815 steel is approximately 0.00191%/.degree. F. Moreover, the SAE 4715 steel is more cost effective to produce when compared with PS-55 and SAE 4815 steels.

It is generally desired that steels useful for forming drill bit blanks according to the principles of this invention have a rate of expansion percentage change, as introduced above, that is less than about 0.0025%/.degree. F., and more preferably less than about 0.002%/.degree. F. As illustrated in FIG. 5, low carbon, low alloy steels of this invention provide the desired thermal expansion characteristic that makes them particularly well suited for application as a drill bit blank.

While the invention has been disclosed with respect to a limited number of embodiments, numerous variations and modifications therefrom exist. For example, the matrix body may be manufactured by a sintering process, instead of an infiltration process. Although embodiments of the invention are described with respect to PDC drill bits, the invention is equally applicable to other types of bits, such as polycrystalline cubic boron nitride bits, tungsten carbide insert rock bits, and the like. In addition to tungsten carbide, other ceramic materials or cermet materials may be used, e.g., titanium carbide, chromium carbide, etc. It is intended that the appended claims cover all such modifications and variations as fall within the true spirit and scope of the invention.

What is claimed is:

1. A reinforcing member disposed within an earth-boring drill bit, body, the drill bit body comprising a number of blades extending outwardly from the body and being formed from a matrix material, wherein the reinforcing member is formed from a high-strength steel that is different from the matrix material and that includes carbon, wherein the carbon is present in an amount of less than about 0.3 percent by weight, and including chromium, wherein chromium is present in an amount of less than about 0.8 percent by weight.

2. The reinforcing member as recited in claim 1, wherein the high-strength steel has a rate of expansion percentage change less than about 0.0025%/° F. during austenitic to ferritic phase transformation.

3. The reinforcing member as recited in claim 1 wherein the high-strength steel comprises in the range of from about 0.1 to 0.3 percent by weight carbon, 0.5 to 1.5 percent by weight manganese, 0.05 to 4 percent by weight nickel, and 0.02 to 0.8 percent by weight molybdenum.

4. The reinforcing member as recited in claim 1 wherein the high-strength steel comprises in the range of from about 0.13 to 0.18 percent by weight carbon, 0.7 to 0.9 percent by weight manganese, 0.45 to 0.65 percent by weight chromium, 0.7 to 1 percent by weight nickel, and 0.45 to 0.65 percent by weight molybdenum, and a remaining amount iron.

5. The reinforcing member as recited in claim 1 wherein the high-strength steel comprises in the range of from about 0.1 to 0.3 percent by weight carbon, 0.9 to 1.5 percent by weight manganese, 0.1 to 0.5 percent by weight silicon, and one or more microalloying elements selected from the group consisting of vanadium, niobium, titanium, zirconium, aluminum and mixtures thereof.

6. The reinforcing member as recited in claim 5 wherein the one or more microalloying elements is present up to about 0.2 total. percent by weight.

7. The reinforcing member as recited in claim 1 wherein the high-strength steel comprises in the range of from about 0.1 to 0.3 percent by weight carbon, 0.9 to 1.5 percent by weight manganese, 0.01 to 0.25 percent by weight chromium, 0.01 to 0.25 percent by weight nickel, 0.001 to 0.1 percent by weight molybdenum, 0.15 to 0.3 percent by weight silicon, and a microalloying element selected from the group consisting of 0.05 to 0.15 percent by weight vanadium, 0.01 to 0.1 percent by weight niobium, and 0.01 to 1 percent by weight titanium, and a remaining amount iron.

8. An earth-boring drill bit comprising:

a bit body having a lower end comprising an outer surface formed from a wear resistant material, and an upper section for connecting the drill bit to a drill string;

one or more blades extending outwardly from the outer surface of the bit body;

one or more cutting members disposed on the one or more blades for engaging an earthen formation; and a reinforcing member connected to and disposed within the bit body, the reinforcing member being formed from a high-strength alloy steel including carbon, wherein the carbon content is less than about 0.3 percent by weight, and including chromium, wherein the chromium content is less than about 0.8 percent by weight.

9. The drill bit as recited in claim 8 wherein high-strength alloy steel is selected from the group of steels having a yield strength of at least 55,000 psi, a tensile strength of at least 80,000 psi, and a toughness of at least 40 CVN-L, Ft-lb.

10. The drill bit as recited in claim 8 wherein the high-strength alloy steel has a rate of expansion percentage change less than about 0.0025%/° F. during austenitic to ferritic phase transformation.

11. The drill bit as recited in claim 8 wherein the reinforcing member is connected to the drill bit body upper section, and wherein the high-strength alloy steel is selected from the group of steels consisting of SAE 47xx steels and SAE 48xx steels.

12. The drill bit as recited in claim 11 wherein the high-strength alloy steel comprises in the range of from about 0.1 to 0.3 percent by weight carbon, 0.5 to 1.5 percent by weight manganese, 0.05 to 4 percent by weight nickel, and 0.02 to 0.8 percent by weight molybdenum.

13. The drill bit as recited in claim 11 wherein the high-strength alloy steel comprises in the range of from about 0.13 to 0.18 percent by weight carbon, 0.7 to 0.9 percent by weight manganese, 0.45 to 0.65 percent by weight chromium, 0.7 to 1 percent by weight nickel, and 0.45 to 0.65 percent by weight molybdenum, and a remaining amount iron.

14. The drill bit as recited in claim 8 wherein the high-strength alloy steel comprises in the range of from about 0.1 to 0.3 percent by weight carbon, 0.9 to 1.5 percent by weight manganese, 0.1 to 0.5 percent by weight silicon, and one or more microalloying element selected from the group consisting of vanadium, niobium, titanium, zirconium, aluminum and mixtures thereof.

15. The drill bit as recited in claim 14 wherein the one or more microalloying element is present up to about 0.2 total percent by weight.

16. The drill bit as recited in claim 8 wherein the high-strength alloy steel comprises in the range of from about 0.1 to 0.3 percent by weight carbon, 0.9 to 1.5 percent by weight manganese, 0.01 to 0.25 percent by weight chromium, 0.01 to 0.25 percent by weight nickel, 0.001 to 0.1 percent by weight molybdenum, 0.15 to 0.3 percent by weight silicon, and a microalloying element selected from the group consisting of 0.05 to 0.15 percent by weight vanadium, 0.01 to 0.1 percent by weight niobium, and 0.01 to 1 percent by weight titanium, and a remaining amount iron.

17. An earth-boring drill bit comprising:

a bit body having a lower end comprising an outer surface formed from a wear resistant material, and an upper section for connecting the drill bit to a drill string;

a cutting member disposed on the outer surface for engaging an earthen formation; and a reinforcing member disposed within and attached to the bit body, the reinforcing member being formed from a high-strength alloy steel including carbon, wherein the carbon content is less than about 0.3 percent by weight and including chromium, wherein the chromium content is less than about 0.8 percent by weight, and has a rate of expansion percentage change less than about 0.002%/° F. during austenitic to ferritic phase transformation.

18. The drill bit as recited in claim 17 wherein the high-strength alloy steel is selected from the group consisting of SAE 47xx steels and SAE 48xx steels.

19. The drill bit as recited in claim 17 wherein the high-strength alloy steel comprises in the range of from about 0.1 to 0.3 percent by weight carbon, 0.5 to 1.5 percent by weight manganese, up to about 0.8 percent by weight chromium, 0.05 to 4 percent by weight nickel, and 0.02 to 0.8 percent by weight molybdenum.

20. The drill bit as recited in claim 17 wherein the high-strength alloy steel comprises in the range of from about 0.1 to 0.3 percent by weight carbon, 0.9 to 1.5 percent by weight manganese, 0.1 to 0.5 percent by weight silicon, and one or more microalloying element selected from the group consisting of vanadium, niobium, titanium, zirconium, aluminum and mixtures thereof.

21. The drill bit as recited in claim 20 wherein the one or more microalloying element is present up to about 0.2 total percent by weight.

* * * * *